US009534860B2

(12) United States Patent
Leimer

(10) Patent No.: US 9,534,860 B2
(45) Date of Patent: Jan. 3, 2017

(54) GAS-OPERATED FIREARM

(71) Applicant: L&O HUNTING GROUP GMBH, Isny (DE)

(72) Inventor: Jan Leimer, Mestecko Trnavka (CZ)

(73) Assignee: L&O Hunting Group GmbH, Isny (DE)

( * ) Notice: Subject to any disclaimer, the term of this patent is extended or adjusted under 35 U.S.C. 154(b) by 0 days.

(21) Appl. No.: 14/793,997

(22) Filed: Jul. 8, 2015

(65) Prior Publication Data

US 2016/0010932 A1 Jan. 14, 2016

(30) Foreign Application Priority Data

Jul. 9, 2014 (DE) ..... 10 2014 109 567

(51) Int. Cl.
*F41A 5/18* (2006.01)
*F41A 5/26* (2006.01)
(Continued)

(52) U.S. Cl.
CPC .. *F41A 5/26* (2013.01); *F41A 3/34* (2013.01); *F41A 5/18* (2013.01); *F41A 21/28* (2013.01); *F41A 21/485* (2013.01)

(58) Field of Classification Search
CPC ..... F41A 5/26; F41A 3/34; F41A 5/18; F41A 5/22; F41A 5/28
See application file for complete search history.

(56) References Cited

U.S. PATENT DOCUMENTS 1,363,262 A 12/1920 North
2,077,415 A * 4/1937 House ..... F41A 3/46 89/187.01
(Continued)

FOREIGN PATENT DOCUMENTS

DE 19836964 C1 12/1999
DE 10323338 A1 12/2004
(Continued)

OTHER PUBLICATIONS

Result of examination report for German Patent Application No. 10 2014 109 567.7 filed Jul. 9, 2014.

*Primary Examiner* — Stephen M Johnson
(74) *Attorney, Agent, or Firm* — Paul D. Bianco; Gary S. Winer; Fleit Gibbons Gutman Bongini & Bianco PL

(57) ABSTRACT

A gas-operated firearm with a lock housing, a guide rod projecting forward from the lock housing, as seen in the shooting direction, for a lock activation device, which is located so it can be displaced on the guide rod and which interacts with a lock for its movement between a locking position and an unlocking position, and a barrel with a gas withdrawal block fastened on the lock housing, which contains at least one gas withdrawal borehole that opens into the barrel, and a pressure piston that is guided so that it can be displaced in the gas withdrawal block for the displacement of the lock activation device against the force of a lock spring. A simplified installation and dismantling of the barrel can thus be made possible in that the barrel contains a rear part, which can be placed on the lock housing and can be firmly connected with it, and a front part, which freely projects from the lock housing, without a firm connection with the guide rod.

16 Claims, 3 Drawing Sheets

(51) Int. Cl.

| | |
|---|---|
| ***F41A 21/28*** | (2006.01) |
| ***F41A 3/34*** | (2006.01) |
| ***F41A 21/48*** | (2006.01) |

(56) References Cited

U.S. PATENT DOCUMENTS

| | | | | |
|---|---|---|---|---|
| 2,373,213 | A | 4/1945 | Williams | |
| 6,276,256 | B1 | 8/2001 | Kimmig | |
| 7,469,624 | B1 * | 12/2008 | Adams | F41A 5/26<br>89/191.01 |
| 2007/0131104 | A1 * | 6/2007 | Botty | F41A 3/26<br>89/193 |

FOREIGN PATENT DOCUMENTS

| | | | |
|---|---|---|---|
| DE | 102009051416 | | 7/2010 |
| DE | 102009051416 | A1 | 7/2010 |
| DE | 10 2009 051 416 | A1 | 9/2010 |
| FR | 1182031 | | 6/1959 |
| FR | 1182031 | A | 6/1959 |

* cited by examiner

GAS-OPERATED FIREARM

FIELD OF THE INVENTION

The invention concerns a gas-operated firearm.

BACKGROUND

Such a gas-operated firearm is known by the name of Sauer 303. It also contains a system box or a lock housing, a guide rod that projects forward, as seen in the shooting direction, and a lock activation device, which is arranged so it can be displaced on the guide rod and which interacts with a lock for its movement between a locking position and an unlocking position. A barrel with a gas withdrawal block is affixed to the lock housing. It contains at least one gas withdrawal borehole that opens into the barrel and a pressure piston that is guided so it can be displaced axially in the gas withdrawal block, for displacement of the lock activation device against the force of a lock spring. In this known gas-operated firearm, the rear end of the barrel is inserted into a corresponding holder borehole of the lock housing and it is firmly connected by a connecting piece, in the area of the gas withdrawal block, with the front end of the guide rod. For the installation or dismantling of the barrel, the front shaft must first be removed in this known gas-operated firearm and then the connection between the barrel and the guide rod must be loosened, before the barrel can be pulled out from the holder borehole of the lock housing.

With other known gas-operated firearms, the front shaft must always first be dismantled if the barrel is to be removed.

SUMMARY

The disclosure related to a gas-operated firearm which, in certain embodiments, makes possible a simplified installation and dismantling of the barrel.

Appropriate refinements and advantageous embodiments of the invention are also disclosed.

In the gas-operated firearm in accordance with the invention, the barrel has a rear part that can be placed on the lock housing and can be firmly connected with it, and with a front part that projects freely from the lock housing, without a firm connection with the guide rod. In this way, the barrel can be simply removed upward for the dismantling even without a prior dismantling of the front shaft. No connections on the front side of the barrel need to be loosened, and the barrel need not be pulled out of a barrel holder, either. For the installation, the barrel can be simply placed on the lock housing and can be connected with it. Thus, the dismantling and installation of the barrel can be considerably simplified, and a simpler dismantling of the automatic firearm can be attained.

In a particularly advantageous embodiment, the rear part and the front part of the barrel can be made as a single piece, wherein in the rear part of the barrel, there is a cartridge ejection port.

A quick and simple fastening of the barrel can be appropriately attained in that retention bolts that protrude on the rear part of the barrel for engagement in corresponding boreholes are located in a support part of the lock housing. With the aid of nuts accessible from the underside of the lock housing, or the like, the barrel can thus be loosened or fastened simply and quickly.

In another advantageous manner, the lock activation device contains a carrier guided on the guide rod and two push rods fastened on the carrier. The carrier has a holder for the gas withdrawal block that is open toward the top. The gas withdrawal block can be simply inserted into this holder during the installation of the barrel. On the free rear ends, push rods can be provided with control cams interacting with the lock for the movement of the lock between the locking and unlocking positions.

A simple dismantling with few parts on the barrel can also be made possible in that the pressure piston is integrated in the gas withdrawal block located in the middle area of the barrel.

BRIEF DESCRIPTION OF THE DRAWINGS

Other features and advantages of the invention can be deduced from the following description of a preferred embodiment example with the aid of the drawing. The figures show the following.

DETAILED DESCRIPTION

Figure 1:
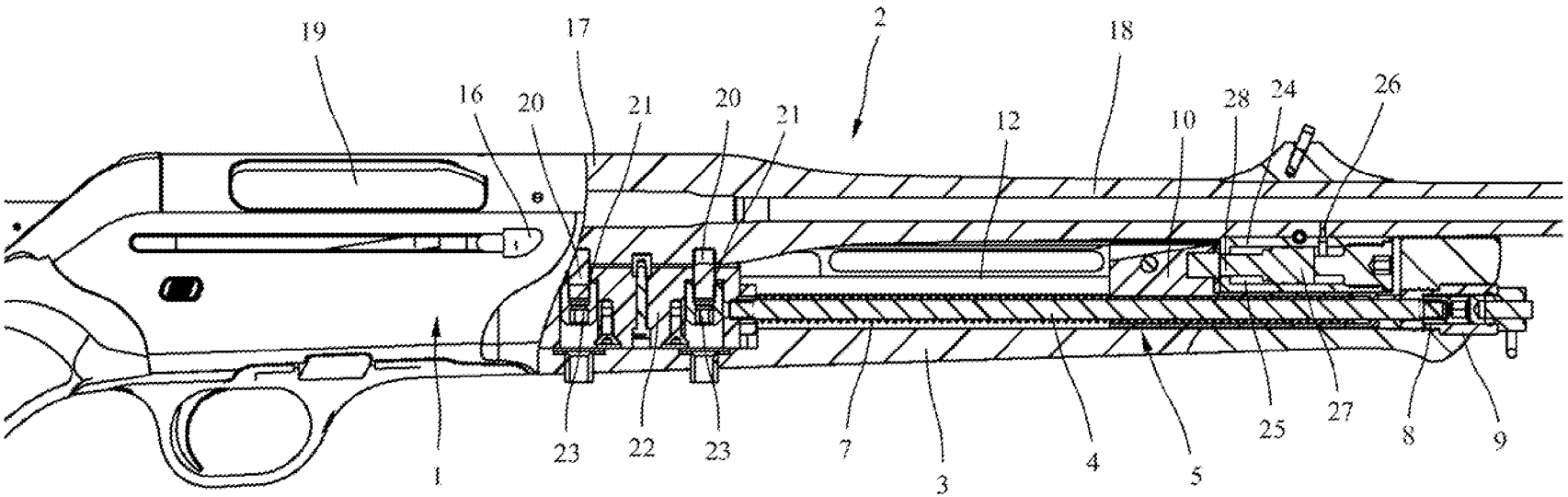
FIG. 1, a partial longitudinal section of a gas-operated firearm with an installed barrel.
Figure 2:
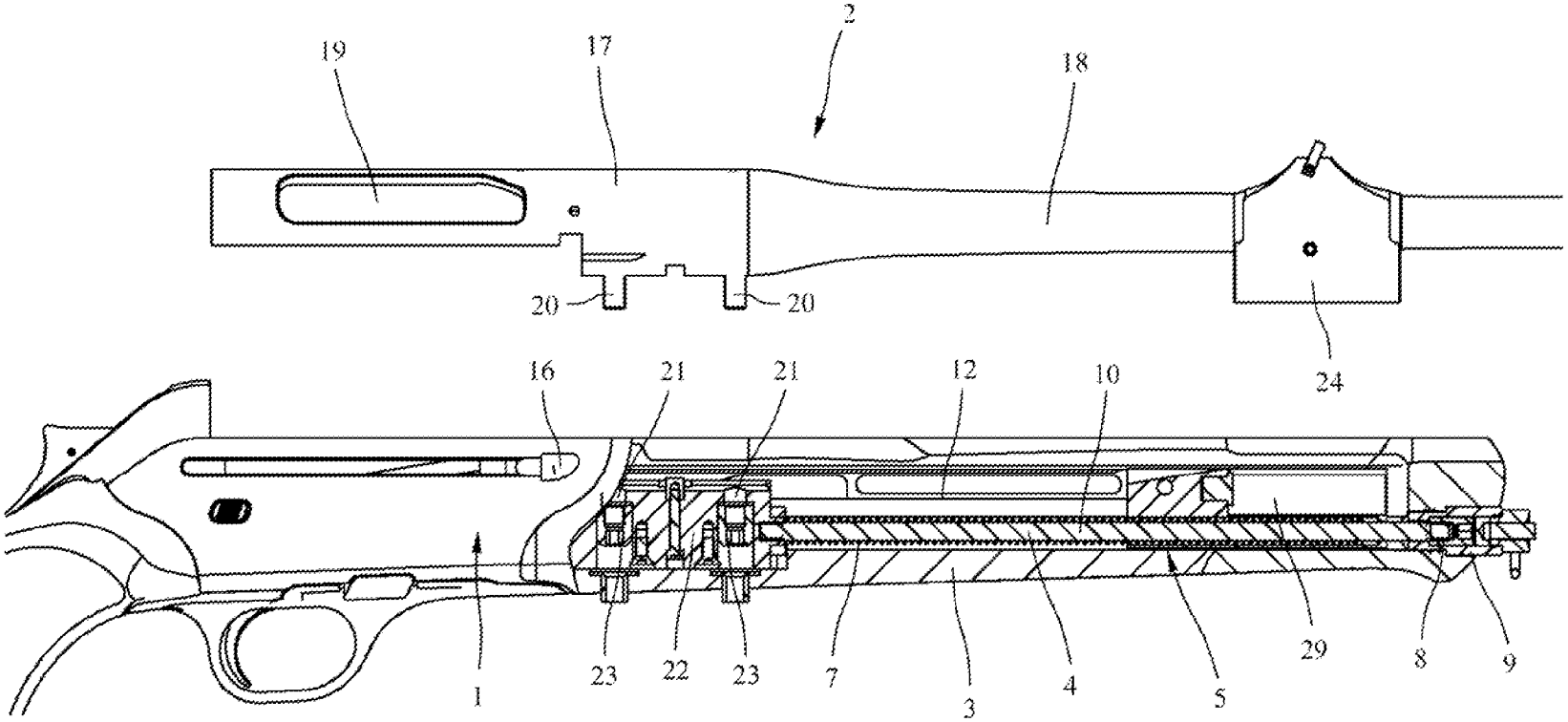
FIG. 2, a partial longitudinal section of the gas-operated firearm of FIG. 1 with a dismantled barrel.

FIGS. 1 and 2 show a partial longitudinal section of a gas-operated firearm with a system box or lock housing 1 including an operating handle 16, a barrel 2 fastened on the lock housing 1, and a front shaft 3. A guide rod 4, protruding forward as seen in the shooting direction and parallel to the bore axis of the barrel 2, is fastened to the lock housing 1. On the guide rod 4, which protrudes forward freely and is not fastened on the barrel 2, a lock activation device 5 for the movement of the lock 6, which is shown separately in a perspective view in FIG. 3 and is explained in more detail below, is guided so that it can be displaced. Furthermore, there is a lock spring 7 on the guide rod 4, via which the lock actuation device 5 is pressed forward. Via an external thread 8 on the front free end of the guide rod 4 and a threaded sleeve 9, which is provided with a corresponding internal thread, the front end of the front shaft 3, as seen in the shooting direction, is fastened on the guide rod 4.

Figure 3:
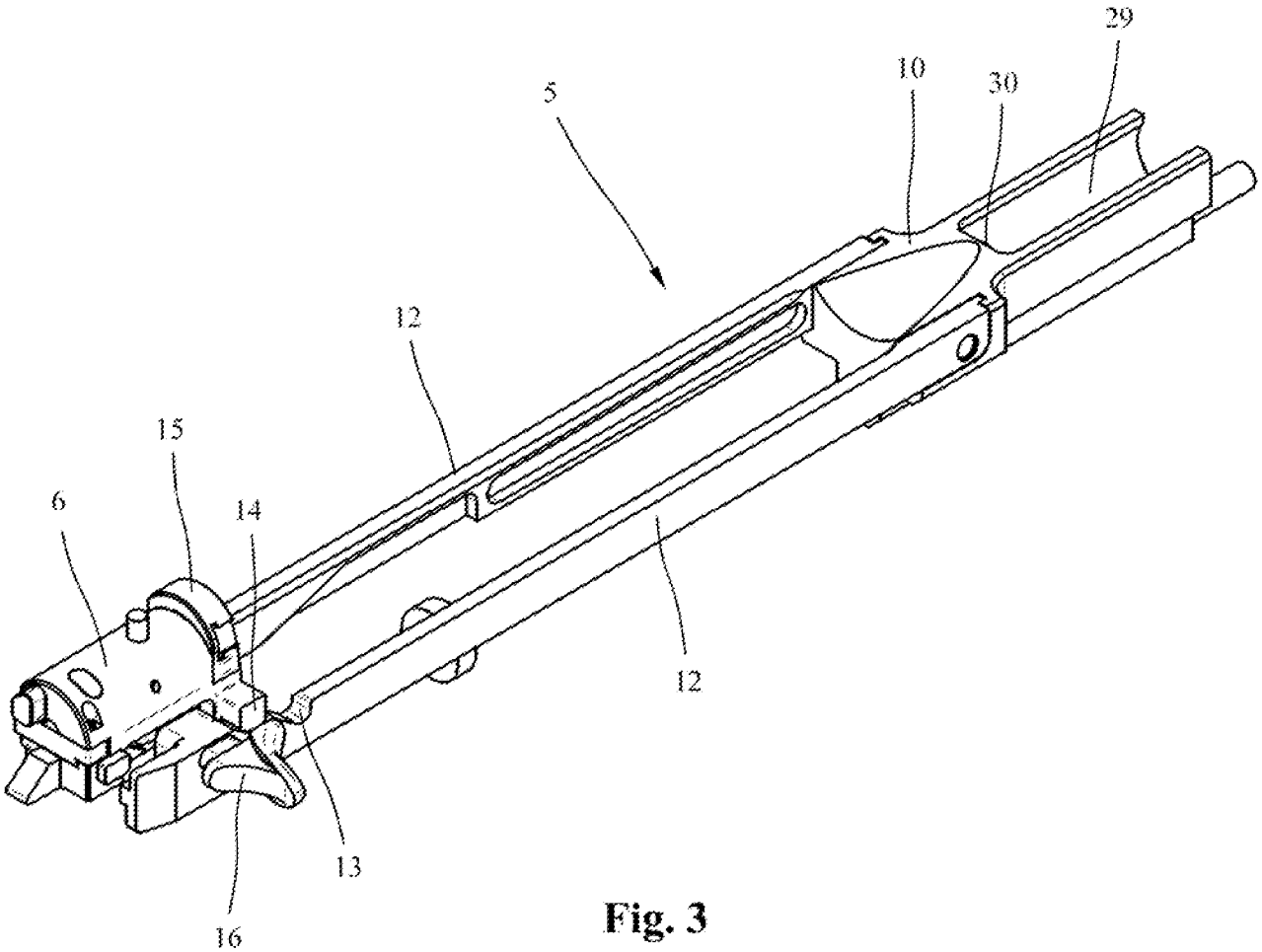
FIG. 3, a lock activation device with a lock in a perspective view.

The lock actuation device 5, shown in perspective in FIG. 3, has a carrier 10, which is guided so it can be displaced on the guide rod 4, and two push rods 12 which are fastened on the carrier 10. A ramp-shaped control cam 13 is provided on the rear free ends of the two push rods 12, as seen in the shooting direction; via the control cam, the lock 6, which is provided with lateral projections 14, can be moved, by a displacement of the actuation device 5, between an upper locking position, shown in FIG. 3, and a lower unlocking position. Via the lock spring 7, which is located on the guide rod 4 and clamped between the lock housing 1 and the carrier 10, the lock actuation device 5 is pressed forward into the locking position shown in FIG. 3, as seen in the shooting direction. In this position, the lock 6 is pressed upward, so that a locking block 15, which projects upward from the upper side of the lock 6, arrives on the barrel 2 for engagement in a locking groove that is not shown. If, on the other hand, the lock activation device 5 is pushed, either via the lock grip 16 or the gas pressure during the release of a shot against the force of the lock spring 7 in a shooting direction, as seen from behind, the lock 6 can move downward as a result of the control cam 13, and the locking block 15 for the opening of the lock can fail to engage with the locking groove on the barrel 2.

From FIGS. 1 and 2, it is clear that the barrel 2 has a rear part 17, which can be placed on the lock housing 1 and can be firmly connected with it, and a front part 18, which freely projects from the lock housing 1. An ejection port 19 for ejection of cartridges is provided on the rear part 17 of the barrel 2, which is enlarged in its diameter in comparison to the front part 18. The rear part 17 and the front part 18 of the barrel 2, as seen in the shooting direction, are made as a single piece in the embodiment shown. The two parts 17 and 18 of the barrel 2 can, however, also be made as individual parts, stuck together, and, for example, be firmly connected with one another by welding or by some other suitable connection.

For the fastening of the barrel 2 on the lock housing 1, two radially projecting retention bolts 20 are provided on the rear part 17 of the barrel 2 lying on the lock housing 1. The retention bolts 20, provided with an external thread, can be inserted radially into the rear part of the barrel 2 or be directly shaped on the barrel 2. The retention bolts 20 are made for engagement in two boreholes 21, located next to one another, in a projecting support part 22 of the lock housing 1. With two nuts 23, accessible from the underside of the lock housing 1, the barrel 2 can be fastened on the lock housing 1, with its front part 18 freely projecting forward, via the two retention bolts 20. The rear end of the front shaft 3 is also fastened on the support part 22 of the lock housing 1. A gas withdrawal block 24, projecting downward on the front part 18, is provided in the middle section of the barrel 2.

As can be seen from FIG. 1, the gas withdrawal block 24 has a gas cylinder 25 with a gas withdrawal borehole 26, which opens into the barrel 2, and a pressure piston 27, which is guided so it can be displaced axially in the gas cylinder 25. The pressure piston 27 contains a piston rod 28, which projects through a rear borehole in the gas withdrawal block 24 and which interacts with the carrier 10 of the lock activation device 5 for the movement of the lock 6 into the unlocking position.

In accordance with FIG. 3 and on its front part, as seen in the shooting direction, the carrier 10 has a U-shaped cross section with a holder 29 and a rear stop 30 for the piston rod 28 of the pressure piston 27. The gas withdrawal block 24 can be simply stuck into the holder 29 of the carrier 10, which is open upward, during the installation of the barrel 2.

The gas-operated firearm described here functions in the following manner:

Upon releasing a shot, a part of the power gases are conducted through the gas withdrawal borehole 26 from the barrel 2 into the gas cylinder 25. By the gas pressure conducted into the gas cylinder 25, the pressure piston 27 is pressed to the rear, as seen in the shooting direction. The lock actuation device 5 is thereby also pushed to the rear, with the carrier 10 and the two push rods 12, against the force of the lock spring 7. By the backward movement of the two push rods 12, the lock 6 can move downward, so that the locking block 15 can arrive on the barrel 2 from the locking and the lock 6 can open the cartridge storage in the barrel to the rear. During the backward movement of the lock 6, the empty cartridge shell is ejected via the ejection port 19 and the lock is under tension. Then, a new cartridge can be brought to the height of the cartridge storage via the magazine spring of a magazine, which is not depicted here. By means of the lock spring 7, the lock is pressed forward via the lock actuation device 5, with the carrier 10 and the two push rods 12, and thereby, the new cartridge is pressed into the cartridge storage. The lock 6 arrives once again into the locking position, via the control cam 13 on the push rods 12, and the lock is closed.

For the dismantling of the barrel 2 in the gas-operating firearm described here, the two shell-shaped nuts 23, which are accessible from the underside of the lock housing 1 and are provided, for example, with a hexagon socket, are loosened with the aid of a hexagon wrench. Then, the entire barrel 2 can be readily removed upward. No prior dismantling of the front shaft 3 is required. Also, for the installation of the barrel 2, it must merely be placed on the lock housing 1 with the front shaft 3 fixed via the guide rod 4 in such a way that the two retention bolts 20 are moved into the boreholes 21, provided for the purpose, in the support part 22 of the lock housing 1, and the gas withdrawal block 24 into the holder 29 of the carrier 10 of the lock activation device 5, guided on the guide rod 4. By tightening the nuts 23, the barrel 2 is then fixed. In this way, a particularly fast and simple installation and dismantling of the barrel 2 is made possible.

What is claimed is:

1. A gas-operated firearm, comprising:

a lock;

a lock housing;

a lock spring;

a guide rod projecting forwards from the lock housing in a shooting direction;

a lock activation device including a carrier biased by the lock spring and moveable upon the guide rod to move the lock between a locking position and an unlocking position;

a barrel including a rear part connectable to the lock housing and a front part with a muzzle, the barrel having a gas withdrawal block including at least one gas withdrawal borehole opening into the barrel, the barrel separable from the firearm without a requirement to remove the guide rod from the lock housing;

a pressure piston movable within the gas withdrawal block to displace the carrier against the force of the lock spring to move the lock into the unlocking position to unlock the lock.

2. The gas-operated firearm according to claim 1, wherein the rear part and the front part of the barrel are made of one single piece.

3. The gas-operated firearm according to claim 1, wherein a cartridge ejection port is located in the rear part of the barrel.

4. The gas-operated firearm according to claim 1, wherein the barrel further includes retention bolts which engage into corresponding boreholes of the lock housing.

5. The gas-operated firearm according to claim 1, wherein the lock activation device includes first and second push rods connected to the carrier.

6. The gas-operated firearm according to claim 5, wherein the lock activation device includes a holder which is open in the direction of the gas withdrawal block, a portion of the gas withdrawal block insertable into the holder as the barrel is connected to the firearm.

7. The gas-operated firearm according to claim 5, further including first and second control cams that interact with the lock during movement of the lock between the locking position and the unlocking position, the first control cam located proximate an end of the first push rod and the second control cam located proximate an end of the second push rod.

8. The gas-operated firearm according to claim 7, wherein each of the first and second control cam engages a lateral projection of the lock.

9. The gas-operated firearm according to claim 1, further including a pressure piston within the gas withdrawal block.

10. A gas-operated firearm, comprising:

a lock;

a lock housing;

a guide rod projecting from the lock housing;

a lock activation device including a carrier moveable upon the guide rod to move the lock between a locking position and an unlocking position, and a holder forming a recess;

a barrel including a rear part connectable to the lock housing, a gas withdrawal block including at least one gas withdrawal borehole opening into the barrel, the barrel separable from the lock housing by lifting the gas withdrawal block out of the holder recess without a requirement to remove the guide rod from the lock housing;

a pressure piston movable within the gas withdrawal block to displace the carrier to move the lock into the unlocking position.

11. The firearm of claim 10, further including a lock spring biasing the carrier so that the lock is biased in the locking position.

12. The firearm of claim 10, wherein the recess of the holder is open in a direction of the barrel.

13. The firearm of claim 12, further including a piston rod connected to the pressure piston, the carrier connected to the lock and the piston rod, the piston rod moveable together with the pressure piston to move the carrier.

14. The firearm of claim 12, wherein the carrier is connected to the lock by two pushrods.

15. The firearm of claim 10, wherein the gas withdrawal block includes a pressure piston moveable by discharge gas admitted through the gas withdrawal borehole.

16. The firearm of claim 10, wherein fasteners are used to affix the barrel to the firearm only proximate the rear part of the barrel.

* * * * *